US009795227B2

(12) United States Patent
Maasen

(10) Patent No.: US 9,795,227 B2
(45) Date of Patent: Oct. 24, 2017

(54) REFRIGERATED MERCHANDISER WITH REMOVABLE FLOOR

(71) Applicant: Classic Ice, LLC, Phoenix, AZ (US)

(72) Inventor: Ryan Maasen, Phoenix, AZ (US)

(73) Assignee: Classic Ice, LLC, Phoenix, AZ (US)

( * ) Notice: Subject to any disclaimer, the term of this patent is extended or adjusted under 35 U.S.C. 154(b) by 0 days.

(21) Appl. No.: 15/214,444

(22) Filed: Jul. 19, 2016

(65) Prior Publication Data

US 2016/0324336 A1 Nov. 10, 2016

Related U.S. Application Data

(63) Continuation-in-part of application No. 14/177,895, filed on Feb. 11, 2014, now Pat. No. 9,392,886.

(51) Int. Cl.
*F25D 3/04* (2006.01)
*F25D 11/00* (2006.01)
(Continued)

(52) U.S. Cl.
CPC ..... *A47F 3/0426* (2013.01); *A47F 3/043* (2013.01); *A47F 3/0404* (2013.01); *B65D 19/38* (2013.01);
(Continued)

(58) Field of Classification Search
CPC .. F25D 2323/02; F25D 2323/023; F25D 3/04; F25D 3/045; F25D 11/00; F25D 13/02; F25D 23/028; F25D 23/06; F25D 23/063; F25D 23/065; F25D 23/067; F25D 2323/024; F25D 2323/06; A47F 3/04; A47F 3/0404; A47F 3/0408; A47F 3/043; A47F 3/0482; A47F 3/06; A47F 2003/066;
(Continued)

(56) References Cited

U.S. PATENT DOCUMENTS 2,131,680 A * 9/1938 Zahodiakin ..... F25D 23/04 312/242
2,686,941 A 8/1954 Patten
(Continued)

FOREIGN PATENT DOCUMENTS

DE 37 05 322 A1 9/1988
EP 0 845 232 A2 6/1998

*Primary Examiner* — Frantz Jules
*Assistant Examiner* — Erik Mendoza-Wilkenfel
(74) *Attorney, Agent, or Firm* — McKee, Voorhees & Sease, PLC

(57) ABSTRACT

A refrigerated merchandiser includes a refrigerated insulated cabinet having a front wall that is hingedly attached to the cabinet. The front wall is rotatable between a closed position covering a storage area in the cabinet and an open position permitting access to the storage area. An opening is provided in the front wall to permit merchandise to be removed from the storage area when the front wall is in the closed position. Adjusting the front wall to the open position permits pallets loaded with merchandise, including ice bags, to be loaded into the merchandiser with a wheeled lifting device such as a forklift or hand jack. The bottom wall of the merchandiser may be removable, such that the entire floor supporting the pallet may be removed and exchanged through the opened front wall. A roller may be provided on the front wall to help in adjusting the front wall between the open and closed positions.

13 Claims, 9 Drawing Sheets

(51) Int. Cl.

| | |
|---|---|
| ***F25D 13/02*** | (2006.01) |
| ***F25D 23/02*** | (2006.01) |
| ***F25D 23/06*** | (2006.01) |
| ***A47F 3/04*** | (2006.01) |
| ***A47F 3/14*** | (2006.01) |
| ***B65D 19/38*** | (2006.01) |
| ***F25C 5/18*** | (2006.01) |

(52) U.S. Cl.
CPC ..... *F25C 5/18* (2013.01); *A47F 3/0434* (2013.01); *B65D 2519/00796* (2013.01)

(58) Field of Classification Search
CPC ..... A47F 3/142; A47F 3/145; A47F 3/063; A47F 3/045
See application file for complete search history.

(56) References Cited

U.S. PATENT DOCUMENTS

| | | | | |
|---|---|---|---|---|
| 3,281,992 | A | 11/1966 | Morrison | |
| 5,996,366 | A | 12/1999 | Renard | |
| 7,032,401 | B2 | 4/2006 | Dresser | |
| 7,913,511 | B2 * | 3/2011 | Meyer | F25D 23/063 62/371 |
| 7,930,801 | B2 * | 4/2011 | Hilger | E05F 7/06 16/18 R |
| 2003/0001468 | A1 * | 1/2003 | Hase | A47B 31/02 312/236 |
| 2003/0084676 | A1 * | 5/2003 | Thurman | A47F 3/0404 62/256 |
| 2004/0226488 | A1 * | 11/2004 | Zakaria | B65G 1/07 108/51.11 |
| 2005/0217306 | A1 | 10/2005 | Renaud | |
| 2005/0257548 | A1 * | 11/2005 | Grassmuck | A47F 3/0447 62/246 |
| 2006/0163984 | A1 * | 7/2006 | Andersen | A47F 3/0486 312/401 |
| 2008/0272565 | A1 * | 11/2008 | Fitzgerald | A47F 3/06 280/47.35 |
| 2010/0074721 | A1 * | 3/2010 | Meers | A47F 3/142 414/469 |
| 2011/0094256 | A1 | 4/2011 | Song et al. | |
| 2012/0031054 | A1 | 2/2012 | Broadbent | |
| 2014/0103062 | A1 * | 4/2014 | Rose, Jr. | G07F 7/0609 221/124 |
| 2015/0013226 | A1 | 1/2015 | Artwohl et al. | |

* cited by examiner

REFRIGERATED MERCHANDISER WITH REMOVABLE FLOOR

CROSS-REFERENCE TO RELATED APPLICATIONS

This application is a continuation-in-part of U.S. application Ser. No. 14/177,895, filed Feb. 11, 2014, the entire contents of which are hereby incorporated by reference.

FIELD OF THE INVENTION

This invention relates generally to refrigerated merchandise displays, and in particular to merchandisers for displaying and selling bags of ice.

BACKGROUND OF THE INVENTION

Bags of ice cubes are commonly sold to retail consumers for use in coolers, to provide extra ice at parties, and other uses. The bags of ice are generally displayed at the retailer in refrigerated merchandisers with one or two doors that open to provide access to the bags of ice.

The retailer or supplier must hand load the bags of ice into the merchandiser through the doors. The hand loading of the bags of ice is time consuming, which adds to the cost of the ice bags to the retailer. It can also be dangerous as the bags can be heavy (commonly weighing 20 pounds or more) and the person loading the bags may be placed in awkward body positions to neatly and fully stack the ice bags within the merchandiser when reaching through the doors. The bags of ice are commonly provided to the retailers loaded on pallets. Even if the ice is made on site, it is typical to store the bagged ice on pallets before the bags are loaded into the merchandiser to be sold. Therefore, there exists a need for a better merchandiser and method of loading bags of ice into the merchandiser.

SUMMARY OF THE INVENTION

The pallet-loaded merchandiser of the present invention is especially well-suited for large box wholesalers that have the ability to drive forklifts or pallet jacks around their stores. The full front of the pallet load merchandiser opens up allowing a forklift or pallet jack to remove any partial pallets of product, place a full pallet of ice in the merchandiser, close the door and be done merchandising. According to one embodiment, the merchandiser includes a removable floor, such that the floor of the merchandiser, with a pallet loaded on it, can be placed within and removed from the merchandiser.

According to one embodiment, the front of the door has a roller that ensures equal weight balance on the hinges. The locking mechanism may be a "quick lock" and allows for an airtight seal to occur for maximum efficiency of the unit.

According to one embodiment the present invention is a refrigerated merchandiser for selling bags of ice provided on pallets. A refrigerated cabinet has a bottom wall, a top wall, and a pair of side walls that define a refrigerated merchandise storage area. A front wall is hingedly attached to the cabinet to rotate about a generally vertical axis. The front wall is movable between an open position that permits a pallet loaded with bags of ice to be slid into and out of the merchandise storage area using a wheeled lifting device and a closed position covering the merchandise storage area. A gasket creates a seal between the front wall and the cabinet when the front wall is in the closed position. An opening through the front wall has a selectively movable cover to permit a consumer to access and remove individual bags from the merchandise storage area through the opening in the front wall while the front wall is in the closed position. The merchandiser may include a support roller mounted to the front wall for providing rolling support of the front wall as it rotates between the open and closed positions. The support roller may be a roller bearing mounted in front wall. The walls of the merchandiser may be insulated. The movable cover may include a transparent portion. A gasket may be provided between the movable cover and the front wall. A ramp may be provided for supporting the wheeled lifting mechanism when the wheeled lifting mechanism is used to slide the pallet loaded with bags of ice into the merchandise area. The ramp may be adjustable between a deployed position and a storage position. Alternatively, the ramp may be stored separately from the merchandiser.

According to another embodiment, the present invention is a method of loading ice bags into a merchandiser. The method includes providing a merchandiser that includes a refrigerated cabinet with a merchandise storage area and a front wall attached to the cabinet rotatable between a closed position covering the merchandise storage area and an open position permitting access to the storage area. The front wall of the merchandiser includes an opening and a moveable cover mounted to the front wall to selectively cover and uncover the opening in the front wall. The method further includes providing a pallet loaded with bags of ice and a lifting mechanism. The front wall is adjusted to the open position. The pallet loaded with bags of ice is loaded on to the fork lift. The lifting mechanism is used to move the pallet loaded with bags of ice into the storage area while the front wall is in the open position. The pallet loaded with bags of ice is left in the storage area of the merchandiser. The lifting mechanism is moved away from the merchandiser and the front wall is adjusted to the closed position with the pallet loaded with bags of ice in the storage area. The lifting mechanism may be a forklift. Alternatively, the lifting mechanism may be a wheeled hand jack, and the method may further include rolling the wheeled hand jack up a ramp and into the merchandise storage area before the pallet loaded with bags of ice is left in the merchandise storage area.

DETAILED DESCRIPTION OF THE PREFERRED EMBODIMENTS

Figure 1:
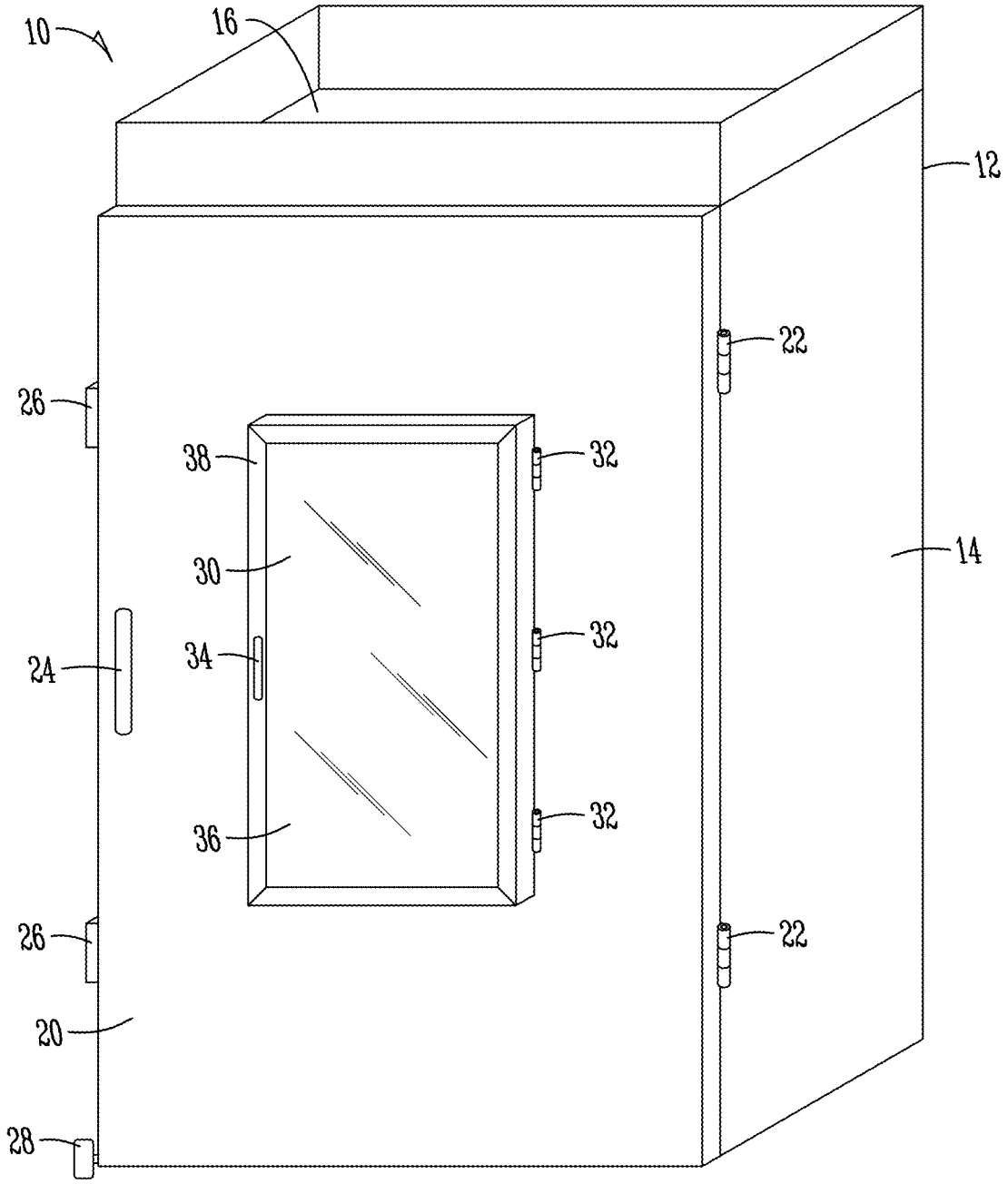
FIG. 1 is an isometric view of a pallet-loaded merchandiser according to one embodiment of the present invention with the front wall in a closed position.

FIG. 1 shows a merchandiser 10 according to one embodiment of the present invention. The merchandiser has an insulated, refrigerated cabinet 12 that includes side walls 14, a top wall 16, a bottom wall 18 (see FIG. 2), and a rear wall 19 (see FIG. 5). A front wall 20 is attached to the cabinet 12 with hinges 22. The hinges 22 permit the front wall 20 to be rotated about a generally vertical axis between the closed position shown in FIG. 1 and an open position shown in FIG. 4. A handle 24 is provided on the front wall 20 to help in moving the front wall 20. A roller 28 is provided at the free end of the front wall 20. The roller 28 engages the floor to help support the weight of the front wall 20 to relieve stress from the hinges 22 and aid in moving the door between the open and closed positions. The roller 28 may be a guide wheel or a caster, or any other suitable weight bearing roller. Latches 26 may also be provided to secure the front wall 20 in a closed position that completely seals the cabinet 12. The latches 26 may be a quick latch that easily flips between open and closed positions. The latches 26 may also be provided with a lock mechanism to prevent consumers from opening the front wall 20.

The front wall 20 includes an opening 48 (see FIG. 3) that permits customers to access the contents of the merchandiser 10 while the front wall 20 is in the closed position. The opening 48 is selectively covered and sealed by front cover 30. The front cover 30 is attached to the front wall 20 by hinges 32. A handle 34 may be provided on the front cover 30 to help consumers in rotating the front cover 30 between the closed position of FIG. 1 and an open position. Preferably the front cover 30 will include a transparent portion 36 to permit users to see into the merchandiser 10 to see the contents of the cabinet 12. The transparent portion 36 may be insulated glass contained within a frame 38.

Figure 2:
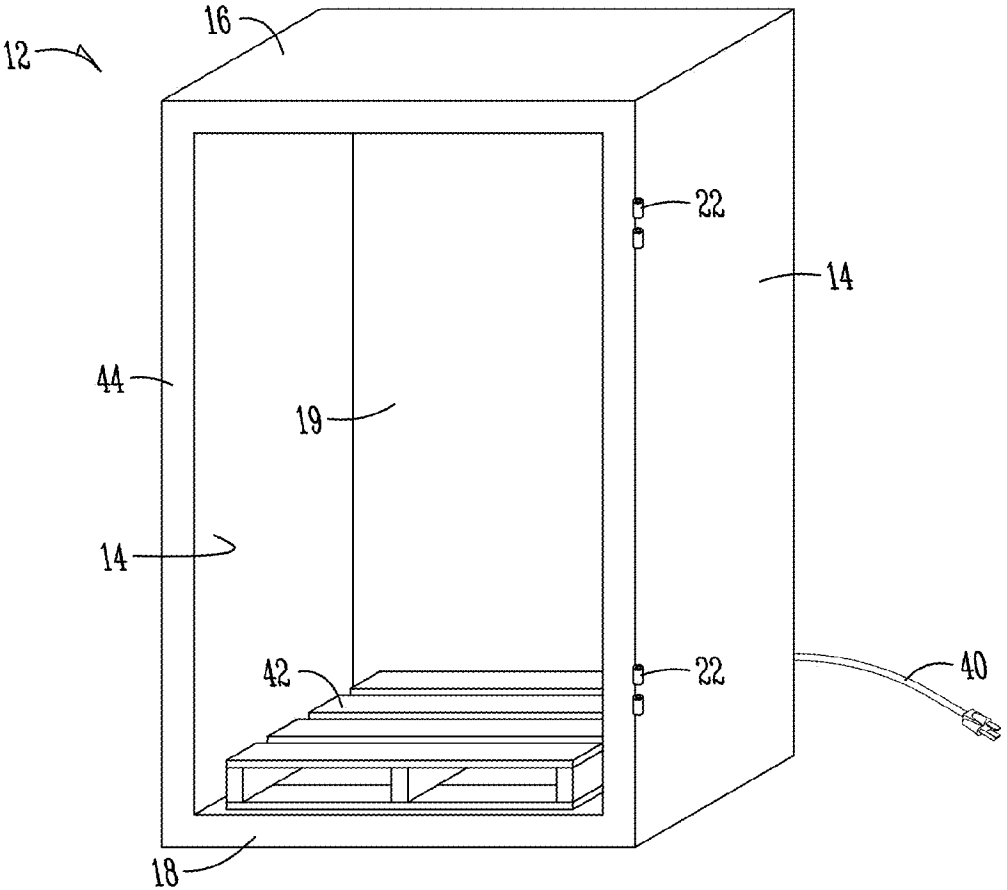
FIG. 2 is an isometric view of the pallet-loaded merchandiser of FIG. 1, with the front wall removed to show the interior of the merchandiser.

FIG. 2 shows the cabinet 12 with the front wall 20 removed to show the interior of the cabinet 12. The interior of the cabinet surrounded by the walls 14, 16, 18, 19, and 20 forms a merchandise display and storage area. An empty pallet 42 is shown supported on the bottom wall 18. The pallet 42 is used to support items being offered for sale, for example bags of ice. A power cord 40 is shown extending from the rear of the merchandiser 10. The power cord 40 is used to connect the merchandiser 10 to a power source (now shown), such as an electric outlet.

The merchandiser 10 includes refrigeration equipment such as a chiller 50 and fan 52 (see FIG. 5) to remove heat to maintain the interior of the cabinet 12 at an appropriate temperature to store the refrigerated items being offered for sale in the merchandise storage area of the merchandiser 10. The chiller 50 may include standard refrigeration equipment (not shown) such as a compressor, an expansion valve, an evaporator, and coils. The merchandiser 10 may also include interior lights (not shown) to illuminate the interior area of the cabinet 12 and exterior lights (not shown) to provide an aesthetic appearance.

The walls 14, 16, 18, and 19 of the cabinet may be insulated to reduce heat exchange across the walls and help maintain a desired temperature within the cabinet 12. The front wall 20 may also be insulated.

Figure 3:
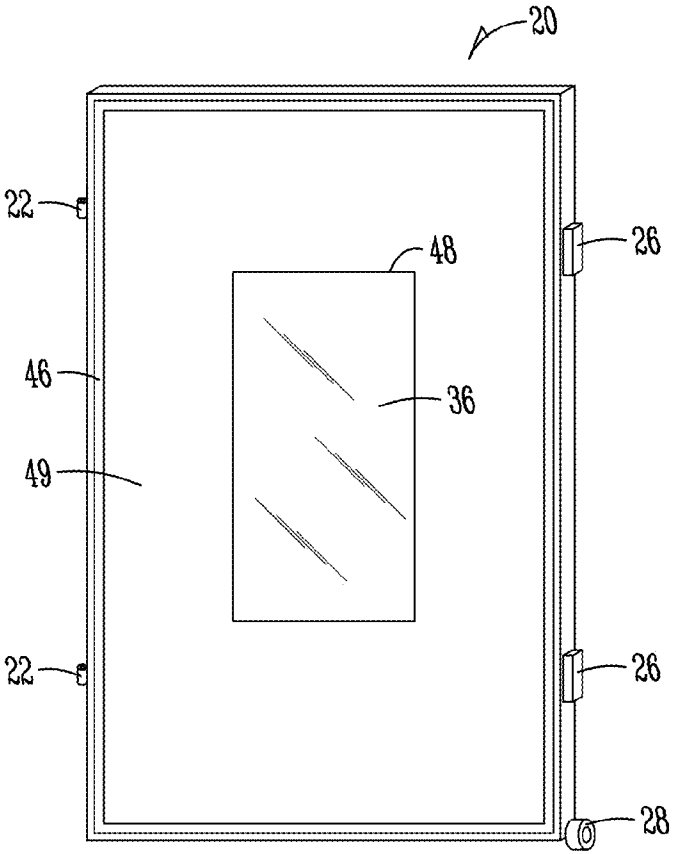
FIG. 3 is a rear elevation view of the front wall of the merchandiser of FIG. 1.

FIG. 3 shows a rear elevation view of the front wall 20. A gasket 46 is provided around the periphery of the inner face 49 of the front wall 20. The gasket 46 aligns with the front face 44 formed by the side, top, and bottom walls (14, 16, 18) of the cabinet 12. Therefore, when the front wall 20 is in the closed position, the gasket 46 is compressed between the front face 44 of the cabinet 12 and the inner face 49 of the front wall 20. Alternatively, the gasket 46 could be provided on the front face 44 of the cabinet 12. The gasket 46 retains cold air within the merchandise storage area of the merchandiser 10.

Figure 4:
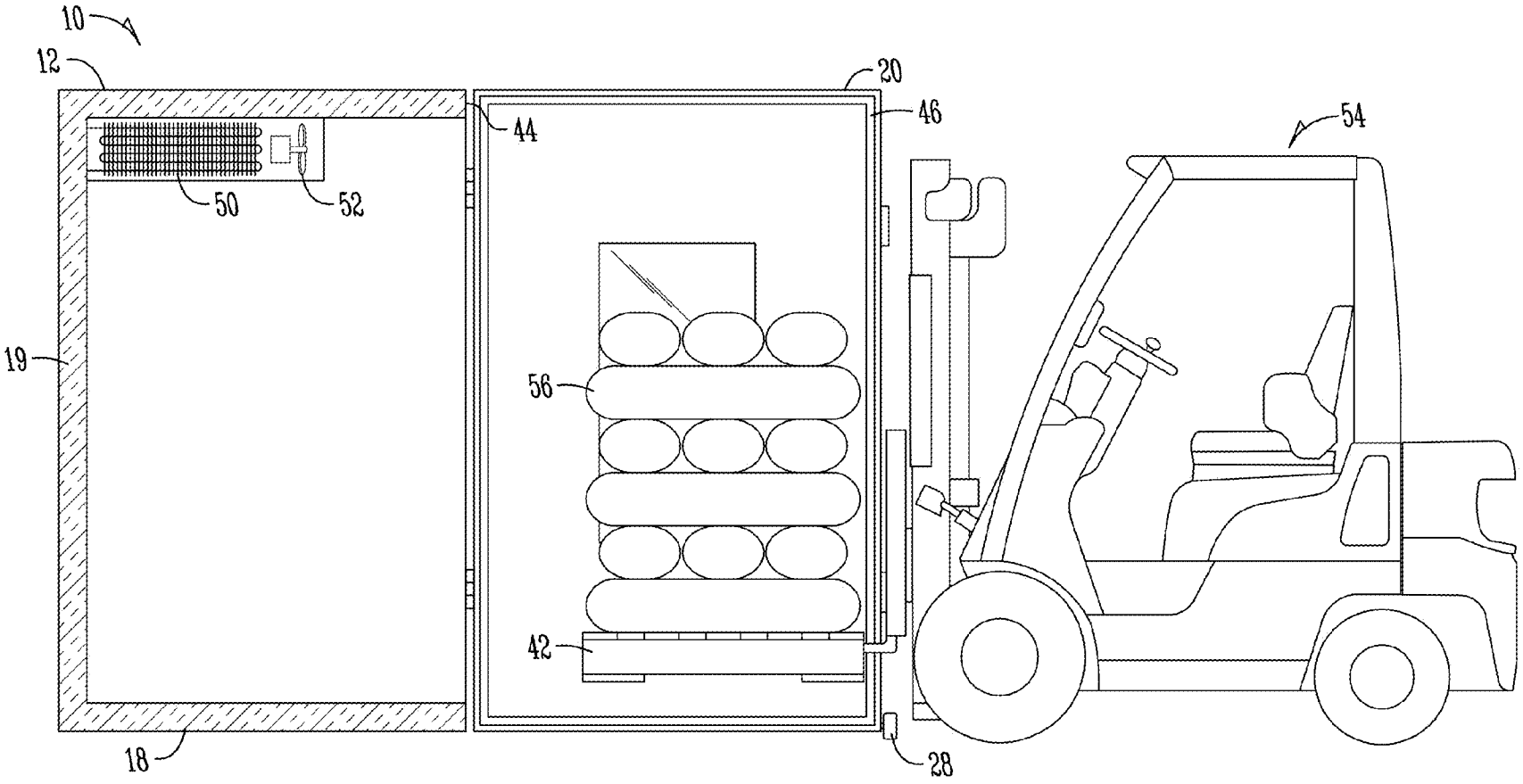
FIG. 4 is cross-section view of a merchandiser according to one embodiment of the present invention with the front wall in an open position and a forklift loading a pallet of ice bags into the merchandiser.

FIG. 4 shows a side elevation view of a forklift 54 being used to load a pallet 42 containing a load of ice bags 56 stacked on the pallet 42 into the merchandiser 10. The left side wall 14 is shown as cut-away in FIG. 4 to illustrate the interior of the merchandiser 10. As can be seen, with the front wall 20 adjusted to the open position shown in FIG. 4, an entire pallet 42 of ice bags 56 can be loaded into the merchandiser at once. It is also contemplated as part of the invention that other items besides bags of ice 56, such as frozen foods, could also be loaded into the merchandiser 10 in a similar fashion. The front wall 20 should be opened sufficiently that it does not interfere with moving the forklift 54 into close proximity to the front face of the cabinet 12 of the merchandiser 10.

Once the pallet 42 is fully within the cabinet 12, the forklift 54 can lower the pallet 42 to be supported on the bottom wall 18 within the refrigerated storage area of the cabinet 12. The forklift 54 can then back away from the cabinet 12, and the front wall 20 can be adjusted back to the closed position shown in FIG. 5.

Figure 5:
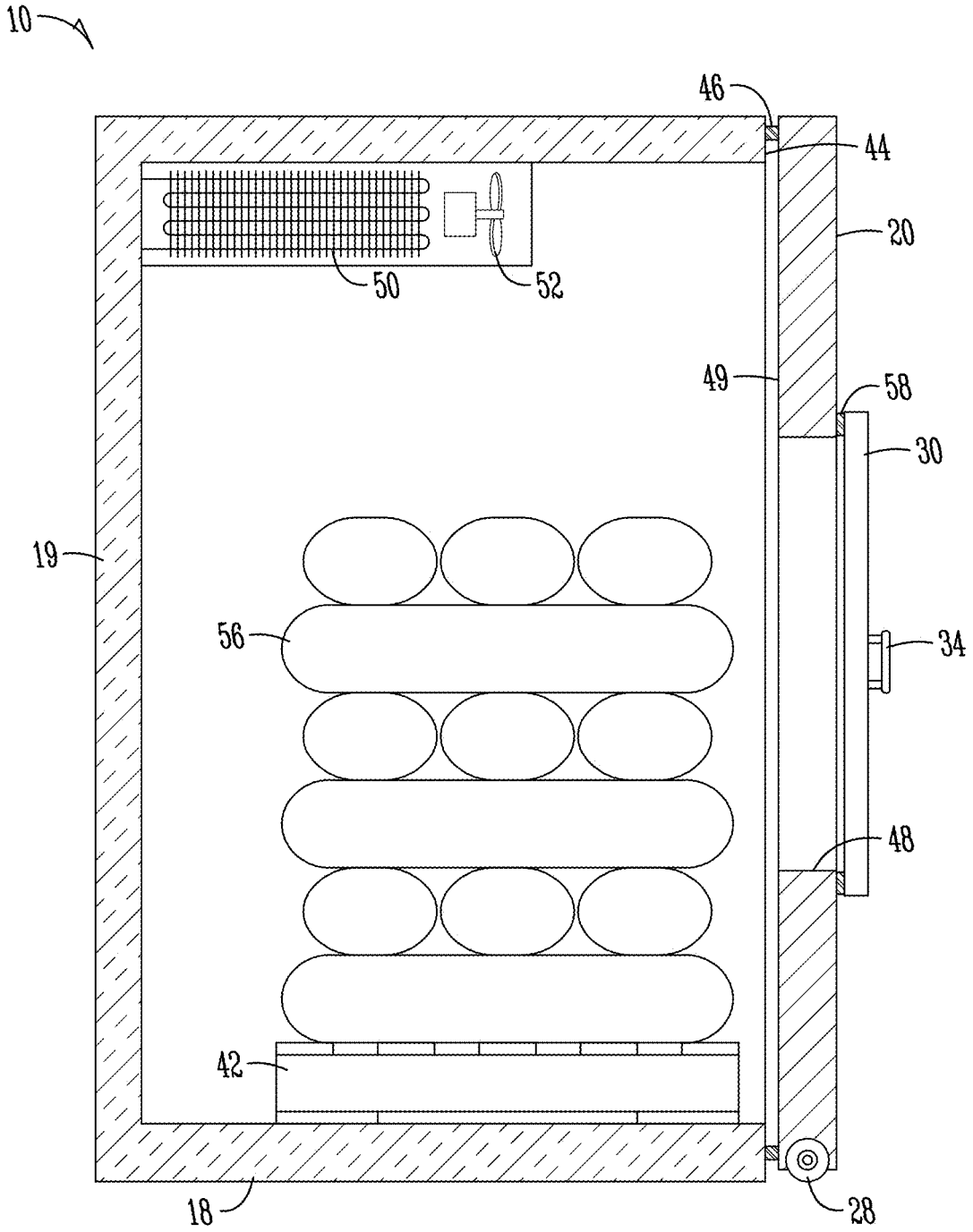
FIG. 5 is a cross-section view of the merchandiser of FIG. 4 with the front wall in the closed position and the pallet of ice bags loaded into the merchandiser.

In FIG. 5, the merchandiser 10 is shown with the front wall 20 in the closed position. The gasket 44 is compressed between the inner face 49 of the front wall 22 and the front face 44 of the cabinet 12. The latches 26 are in a closed position to maintain the front wall 22 in the closed position.

Figure 6:
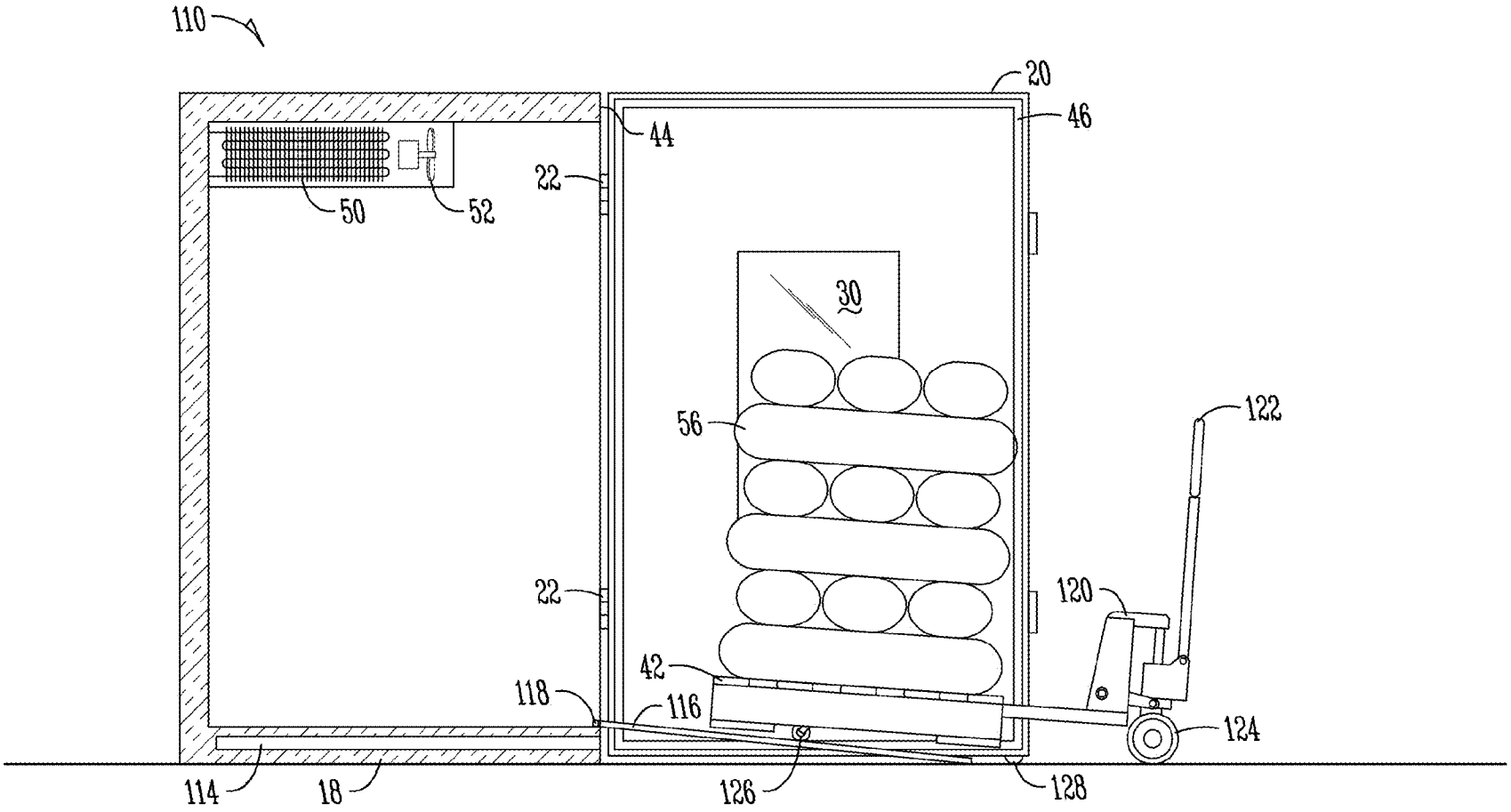
FIG. 6 is a cross-section view of an a merchandiser according to another embodiment of the present invention, wherein a ramp is included, the front wall is shown in an open position and the ramp is shown in a deployed position with a hand jack carrying a pallet of ice bags being rolled up the ramp.
Figure 7:
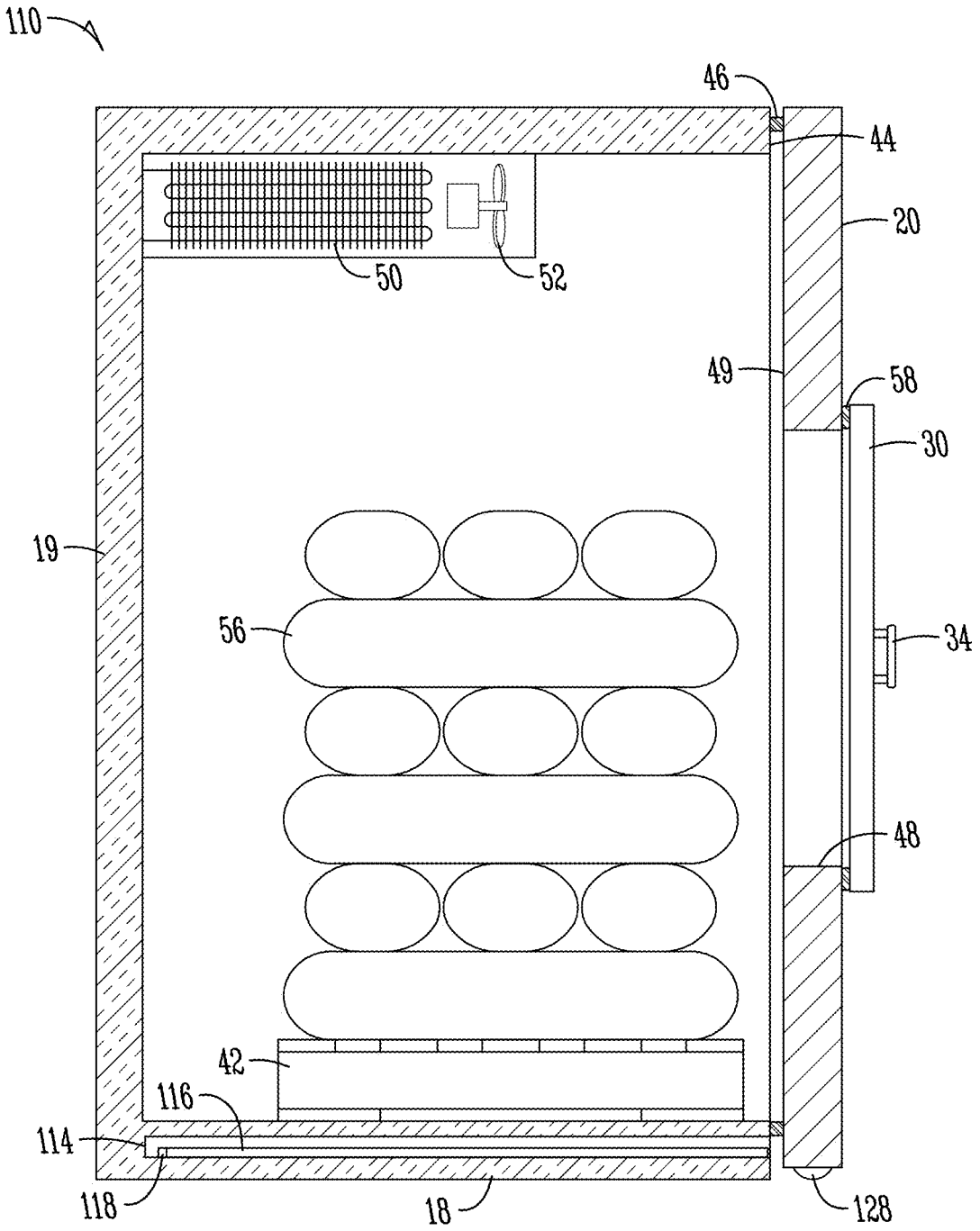
FIG. 7 shows the merchandiser of FIG. 7, after the pallet of ice bags has been placed in the merchandiser and the front wall has been moved to the closed position.

FIGS. 6 and 7 show an embodiment of a merchandiser 110 that similar to the merchandiser 10 of FIGS. 1-5. The cabinet 112 of the merchandiser 110 is modified to include a pocket 114 for storage of a ramp 116. The merchandiser 110 can be especially useful for retailers who cannot, or would prefer not, to use a forklift, especially during hours when consumers may be around. The merchandiser 110 of FIGS. 6 and 7 is suitable for use with a wheeled hand jack 120. The wheeled hand jack 120 may be of con conventional design including front wheels 126, rear wheels 124, a lifting mechanism (not shown), and a handle 122 to guide the wheeled hand jack 120. The ramp 116 can take several forms. According to the embodiment shown, the ramp 0 includes a hook 118 that permits the ramp 116 to attach to the front of the cabinet 112 at a front lip of the bottom wall 18 of the cabinet 112 when in a deployed position as shown in FIG. 6. When not in use, the ramp 116 may be unhooked from the cabinet 112 and slid into the pocket 114 provided at the bottom of the cabinet 112. Preferably the pocket will be located outside the gasket 46 so that the storage space for the ramp is not refrigerated. As an alternative (not shown)

the ramp 116 may be more or less permanently hingedly attached to the cabinet, and may fold into a compact storage position when not in use. As another alternative (not shown), the ramp 116 may be stored on a sleeve or hanger provided on one of the sides of the cabinet 112. Alternatively, a ramp may be provided that stores apart from the cabinet, and is brought out of storage during loading and unloading. Also, as an alternative to the ramp that hooks on to the cabinet, the ramp may be free standing and be deployed abutting the cabinet when in use.

Figure 8:
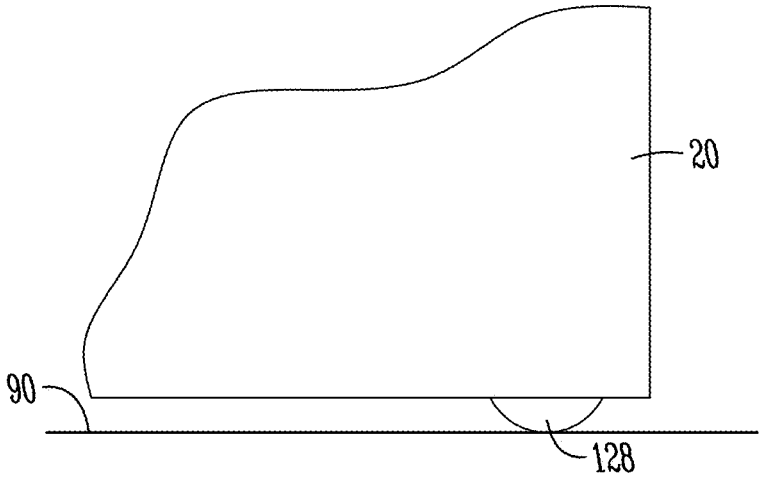
FIG. 8 is a partial detail view of a lower portion of the front wall of an embodiment of the present invention that uses a roller bearing as a support roller.
Figure 9:
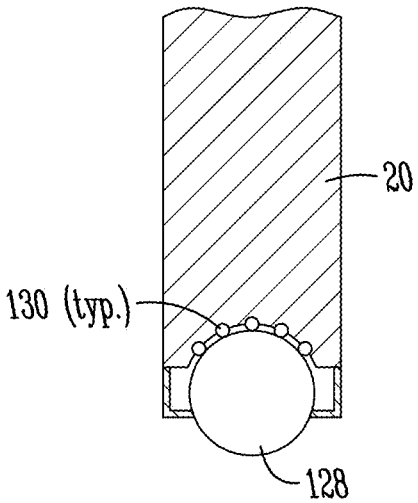
FIG. 9 is a cross-section view of the lower portion of the front wall of with a roller bearing of FIG. 8.

As seen in FIGS. 8 and 9, the roller 28 may take the form of a roller bearing 128. The roller bearing 128 is mounted within the front wall 20. The roller bearing 128 may also include ball bearings 130, or other friction reducing devices to permit easy rolling of the roller bearing 128. A portion of the roller bearing 128 extend below the front wall 20 and rides on the floor 90 to help take weight off the hinges 22 as the front wall 20 is rotated between the open and closed positions.

When the merchandiser 10 is in the configuration of FIG. 5, consumers can see the bags of ice 56 through the transparent portion 36 of the movable cover 30. To remove a bag of ice 56 for purchase, a consumer will open the movable cover 30, reach into the merchandiser through the opening 48, and grab the bag or bags 56 that the consumer desires. The consumer can then shut the movable cover 30 so that it again covers the opening 48. Preferably, the movable cover 30 will be biased to automatically move back into the closed position shown in FIG. 5 so that the cover 30 is not accidentally left open. As can be seen in FIG. 5, a gasket 58 is provided between the cover 30 and the outer face of the front wall 20. The gasket 58 is preferably mounted on the moveable cover 30, but could be mounted to the outer face of the front wall 20 around the periphery of the opening 48.

When the ice bags 56 have been completely removed by consumers from the pallet 42, the retailer can unlatch the latches 26, and rotate the front wall 20 to the open configuration of FIG. 4. The movement of the front wall 20 between the closed and open positions is aided by the roller 28 rolling along the floor to provide support for some of the weight of the front wall 20. Once the front wall 20 is moved to the open position, the empty pallet 42 can be removed from the merchandiser 10 either by hand or using the forklift 54. A new pallet 42 that has been loaded with a full stock of ice bags 56 can then be moved into the merchandiser 10 using the forklift 54, as shown in FIG. 4. Once the loaded pallet 42 has been set in place on the bottom wall 18 by the forklift 54, the forklift 54 can back away from the cabinet 12, and the front wall 20 can be adjusted back to the closed position. In this way, the merchandiser 10 of the present invention can be loaded with a complete pallet full of ice bags 54 in one simple step without the need to hand place the bags 56 within the merchandiser through the opening 48 used by consumers to remove the bags 56. This represents a significant savings to a retailer because of the reduction in time used by employees in loading the ice, the reduction in time when consumers cannot access the ice because it is being loaded, and improved employee safety.

The use of the merchandiser 110 of FIGS. 6 and 7 with the hand jack 120 is similar to that described above, with a few modifications. To load a pallet 24 loaded with bags of ice 56, the front wall 20 must be adjusted to the open position. The ramp 116 can then be removed from the pocket 114 and hooked to the cabinet 112 at a front edge of the bottom wall 18 to be placed in a deployed position. The wheeled hand jack 120, with the pallet 24 loaded on to it, can then be guided up the ramp 116 using the handle 122. Once the loaded pallet 42 has been moved completely into the storage area, the lifting mechanism of the hand jack 120 is used to lower the pallet 42 unto the bottom wall 18. The hand jack 20 can then be rolled back down the ramp 116. The ramp can be stored in the pocket 114, and the front wall 20 can be rotated back to the closed position of FIG. 7 with the front wall 20 being supported by the roller bearing 128. It should be understood that while the merchandiser 110 is shown in use with a hand jack 120, it is also perfectly well suited for use with a forklift similarly to the embodiment of FIGS. 1-5.

Figure 10:
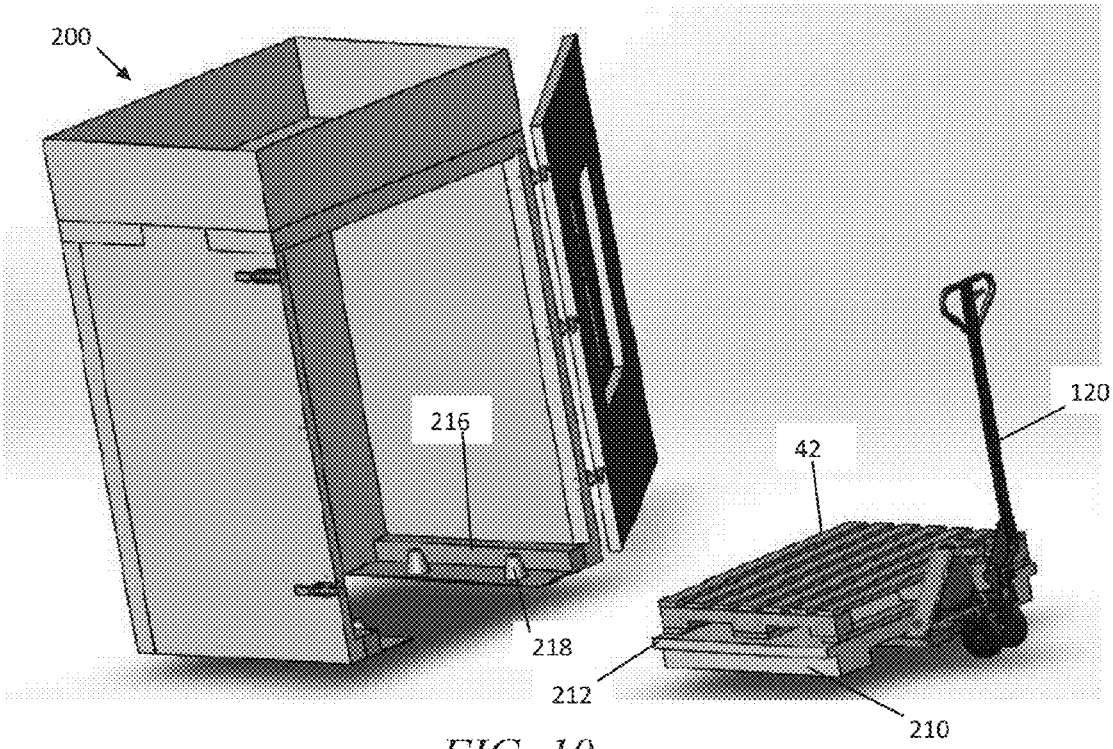
FIG. 10 is a perspective view of a merchandiser according another embodiment of the present invention that includes a removable floor, with the removable floor removed from the merchandiser and supporting an empty pallet.

FIG. 10 is a perspective view of a merchandiser 200 according another embodiment of the present invention. The merchandiser 200 is similar to the merchandiser 10, except that the merchandiser 200 has a removable floor 210. The removable floor 210 has an upper surface 214 that is suitable for supporting a pallet 42. When in place within the merchandiser 200, the removable floor 210 forms a bottom wall of the merchandising area. The lower portion of the removable floor 210 includes slots 220 to receive the fork of a forklift or hand jack. A formed piece of sheet metal, may be used to form the upper surface. It is desirable for the upper surface 214 to be durable, aesthetically pleasing, and easily cleanable. The floor 210 should be sufficiently rigid to support a pallet 42 loaded with merchandise, for example bags of ice. Preferably the floor 210 will be insulated to reduce heat transfer into the merchandising compartment. According to one embodiment the removable floor 210 is constructed out of aluminum tubing filled with self-expanding foam spray. Additional insulation may be added to the floor 210 to improve its insulating properties.

Figure 11:
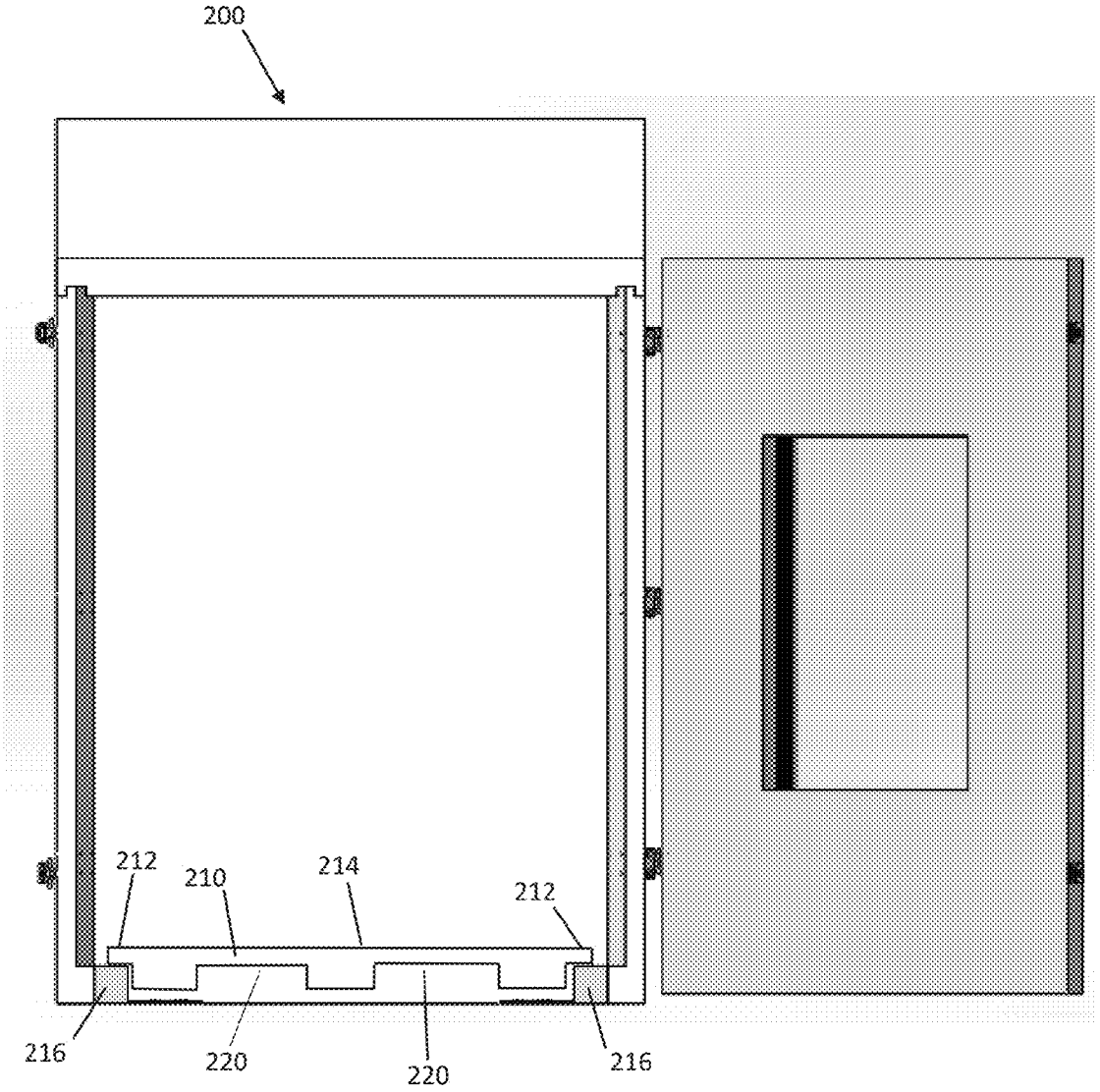
FIG. 11 is a front elevation view of the merchandiser of FIG. 10, with the removable floor in the merchandising area of the merchandiser.

As best seen in FIG. 11, the removable floor 210 includes side flanges 212 that engage and are supported by ledges 216 that are provided at the base of the side walls of the cabinet. The side flanges 212 rest on the ledges 216 to both support the floor and to seal the lower portion of the merchandising compartment. Optionally, a gasket or similar sealing structure (not shown) may be provided on the upper portion of the ledges 216 or the lower surface of the flanges 212 to improve the air seal. Additionally, gaskets or similar sealing structures (not shown) may be provided to seal between the rear wall and the rear surface of the floor 210 and between the front wall and the front surface of the floor 210. Also, optionally, tapered dowels 218 may be provided as alignment aids. The tapered dowels 218 engage female features (not shown) on the bottom of the floor 210 to guide and hold the floor 210 in place within the merchandising compartment. Alternatively, no separate aligning structure is required, and the floor 210 may be properly aligned within the merchandising compartment by pushing the rear edge of the floor 210 into contact with the rear wall.

According to some embodiments, the merchandiser 200 may be provided with multiple removable floors 210, such that pallets 42 may be loaded on to the removable floor 210 at a remote location and a user can change out a floor 210 with an empty pallet for a floor 210 with a loaded pallet, without taking time to load the pallet on to the floor 210.

In addition, numerous various, adjustments, substitutions, and the like may be incorporated into the present invention and are intended to be considered a part of the present invention. It should be understood that additional changes and modifications to the embodiment shown and described herein will be apparent to those skilled in the art. Such changes and modifications may be made without departing from the spirit and scope of the invention, and without diminishing its advantages. It is intended, therefore, that such changes and modifications be covered by the embodiments of the invention.

What is claimed is:

1. A refrigerated merchandiser for selling bags of ice provided on pallets, the merchandiser comprising:

a refrigerated cabinet including a top wall, a rear wall, and a pair of side walls defining a refrigerated merchandise storage area with an open bottom;

a lowermost bottom wall that is selectively removable from the refrigerated cabinet and adapted to be moved into and out of the merchandise storage area using a wheeled lifting device, the bottom wall having an upper surface that is adapted to support a pallet;

a front wall hingedly attached to the refrigerated cabinet to rotate about a generally vertical axis, the front wall being movable between an open position that permits the bottom wall supporting a pallet to be slid into and out of the merchandise storage area using the wheeled lifting device and a closed position covering the merchandise storage area;

a gasket that creates a seal between the front wall and the cabinet when the front wall is in the closed position; and wherein the bottom wall includes a pair of slots adapted to receive forks on the wheeled lifting device for moving the bottom wall into and out of the refrigerated cabinet.

2. The refrigerated merchandiser according to claim 1, further comprising an opening through the front wall with a selectively movable cover to permit a consumer to access and remove individual bags from the merchandise storage area through the opening in the front wall while the front wall is in the closed position.

3. The refrigerated merchandiser of claim 1, further comprising a support roller mounted to the front wall for providing rolling support of the front wall as it rotates between the open and closed positions.

4. The refrigerated merchandiser of claim 3, wherein the support roller is a roller bearing mounted within the front wall and extending partially below the front wall.

5. The refrigerated merchandiser of claim 3, wherein the support roller is a support wheel mounted to an outer face of the front wail.

6. The refrigerated merchandiser of claim 1, wherein the walls are insulated.

7. The refrigerated merchandiser of claim 2, wherein the movable cover includes a transparent portion.

8. The refrigerated merchandiser of claim 2, further comprising a gasket between the movable cover and the front wall.

9. The refrigerated merchandiser of claim 1, further comprising a ramp for supporting the wheeled lifting device when the wheeled lifting device is used to slide the pallet loaded with bags of ice into the merchandise area.

10. The refrigerated merchandiser of claim 9, wherein the ramp is adjustable between a deployed position and a storage position.

11. The refrigerated merchandiser of claim 10, wherein the ramp folds to the storage position.

12. The refrigerated merchandiser of claim 10, wherein the cabinet includes a pocket for retaining the ramp when the ramp is in the storage position.

13. A refrigerated merchandiser system comprising the refrigerated merchandiser of claim 1 and a second removable floor.

* * * * *